US006415461B1

(12) United States Patent
Singer

(10) Patent No.: US 6,415,461 B1
(45) Date of Patent: Jul. 9, 2002

(54) ADJUSTABLE SHOWER SYSTEM

(76) Inventor: Niles H. Singer, 1610 N. 26th St., Bismarck, ND (US) 58501

( * ) Notice: Subject to any disclaimer, the term of this patent is extended or adjusted under 35 U.S.C. 154(b) by 0 days.

(21) Appl. No.: 10/039,716

(22) Filed: Jan. 3, 2002

(51) Int. Cl.[7] ..... A47K 3/00; B05B 15/06

(52) U.S. Cl. ..... 4/601; 4/570; 239/273; 239/282; 239/588

(58) Field of Search ..... 4/601, 615, 567–570, 4/605; 239/273, 282, 588, DIG. 12

(56) References Cited

U.S. PATENT DOCUMENTS

| | | | | | |
|---|---|---|---|---|---|
| 1,758,115 | A | | 5/1930 | Kelly | |
| 2,100,186 | A | * | 11/1937 | Hagopian | 4/569 |
| 2,277,562 | A | * | 3/1942 | Schu | 4/568 |
| 3,121,235 | A | | 2/1964 | Gellmann | 4/148 |
| 3,375,532 | A | * | 4/1968 | Gellmann | |
| 3,971,074 | A | | 7/1976 | Yxfeldt | 4/145 |
| 4,084,271 | A | * | 4/1978 | Ginsberg | |
| 4,282,612 | A | | 8/1981 | King | 4/601 |
| 4,545,083 | A | * | 10/1985 | Searson | 4/570 |
| 4,809,369 | A | | 3/1989 | Bowden | 4/615 |
| 4,865,254 | A | | 9/1989 | Kragle | 239/76 |
| 4,901,927 | A | | 2/1990 | Valdivia | 239/446 |
| 4,927,083 | A | * | 5/1990 | Daunt | 239/282 |
| 4,975,993 | A | | 12/1990 | Black et al. | 4/601 |
| 5,121,882 | A | * | 6/1992 | Skidmore | |
| 5,564,139 | A | | 10/1996 | Shorr | 4/601 |
| 5,678,258 | A | | 10/1997 | Healy | 4/601 |
| D386,567 | S | | 11/1997 | Reeves | D23/213 |
| 5,878,446 | A | * | 3/1999 | McCann | 4/496 |
| 6,065,693 | A | * | 5/2000 | Lukas | 239/273 |
| 6,079,060 | A | | 6/2000 | Walker | 4/601 |

FOREIGN PATENT DOCUMENTS

| | | | | |
|---|---|---|---|---|
| EP | 401 118 | * | 12/1990 | 4/601 |
| GB | 1024300 | * | 3/1966 | 4/601 |
| WO | WO 00/39410 | * | 7/2000 | |

* cited by examiner

*Primary Examiner*—Charles R. Eloshway
(74) *Attorney, Agent, or Firm*—Michael S. Neustel

(57) ABSTRACT

An adjustable shower system for providing multiple showerheads in various locations within a shower without requiring additional plumbing. The adjustable shower system includes a plurality of tubes having opposing female couplers, a plurality of connecting tubes having opposing threaded ends for threadably receiving the female couplers, a control valve fluidly connected to the connecting tube, a showerhead fluidly connected to the control valve, a plurality of suction cups attached to the connecting tube and the tubes, and an end cap attached to that distal threaded end of the last connecting tube. A first tube is fluidly connected to the existing shower pipe within a shower stall by simply removing the existing shower head.

19 Claims, 4 Drawing Sheets

ADJUSTABLE SHOWER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to showers and more specifically it relates to an adjustable shower system for providing multiple showerheads in various locations within a shower without requiring additional plumbing.

2. Description of the Prior Art

Showers have been in use for years. A conventional shower is comprised of typically three walls with a door selectively closing the open portion defined within the walls. A conventional shower typically has only one showerhead positioned in a raised location. Some customized showers have multiple shower head built into the walls of the shower at various heights and positions to disperse water upon a user in various locations.

The main problem with conventional showers is that they do not provide an adjustable shower system for dispersing water upon various selected portions of the body. Another problem with conventional showers is that they require additional plumbing in order to position additional showerheads within the shower which is time consuming, costly and permanent. A further problem with conventional showers that have multiple showerheads is that the showerheads are not repositionable within the shower.

Examples of patented devices which are related to the present invention include U.S. Pat. No. 3,121,235 to Gellmann; U.S. Pat. No. 3,971,074 to Yxfeldt; U.S. Pat. No. 6,079,060 to Walker; U.S. Pat. No. 5,678,258 to Healy; U.S. Pat. No. 5,564,139 to Shorr; U.S. Pat. No. 4,809,369 to Bowden; U.S. Pat. No. 4,282,612 to King; U.S. Pat. No. 1,758,115 to Kelly; U.S. Pat. No. 386,567 to Reeves; U.S. Pat. No. 4,865,254 to Kragle; U.S. Pat. No. 4,901,927 to Valdivia; and U.S. Pat. No. 4,975,993 to Black et al.

While these devices may be suitable for the particular purpose to which they address, they are not as suitable for providing multiple showerheads in various locations within a shower without requiring additional plumbing. Conventional showers do not allow for the convenient adjustment of a plurality of showerheads without the requirement of additional plumbing.

In these respects, the adjustable shower system according to the present invention substantially departs from the conventional concepts and designs of the prior art, and in so doing provides an apparatus primarily developed for the purpose of providing multiple showerheads in various locations within a shower without requiring additional plumbing.

SUMMARY OF THE INVENTION

In view of the foregoing disadvantages inherent in the known types of shower devices now present in the prior art, the present invention provides a new adjustable shower system construction wherein the same can be utilized for providing multiple showerheads in various locations within a shower without requiring additional plumbing.

The general purpose of the present invention, which will be described subsequently in greater detail, is to provide a new adjustable shower system that has many of the advantages of the bathtubs and showers mentioned heretofore and many novel features that result in a new adjustable shower system which is not anticipated, rendered obvious, suggested, or even implied by any of the prior art showers, either alone or in any combination thereof.

To attain this, the present invention generally comprises a plurality of tubes having opposing female couplers, a plurality of connecting tubes having opposing threaded ends for threadably receiving the female couplers, a control valve fluidly connected to the connecting tube, a showerhead fluidly connected to the control valve, a plurality of suction cups attached to the connecting tube and the tubes, and an end cap attached to that distal threaded end of the last connecting tube. A first tube is fluidly connected to the existing shower pipe within a shower stall by simply removing the existing shower head.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an adjustable shower system that will overcome the shortcomings of the prior art devices.

A second object is to provide an adjustable shower system for providing multiple showerheads in various locations within a shower without requiring additional plumbing.

Another object is to provide an adjustable shower system that can be utilized within various types, sizes and structures of showers and bathtubs.

An additional object is to provide an adjustable shower system that does not require a professional plumber to install.

A further object is to provide an adjustable shower system that does not require additional plumbing to install.

Another object is to provide an adjustable shower system that is easily adjusted at anytime without additional plumbing.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
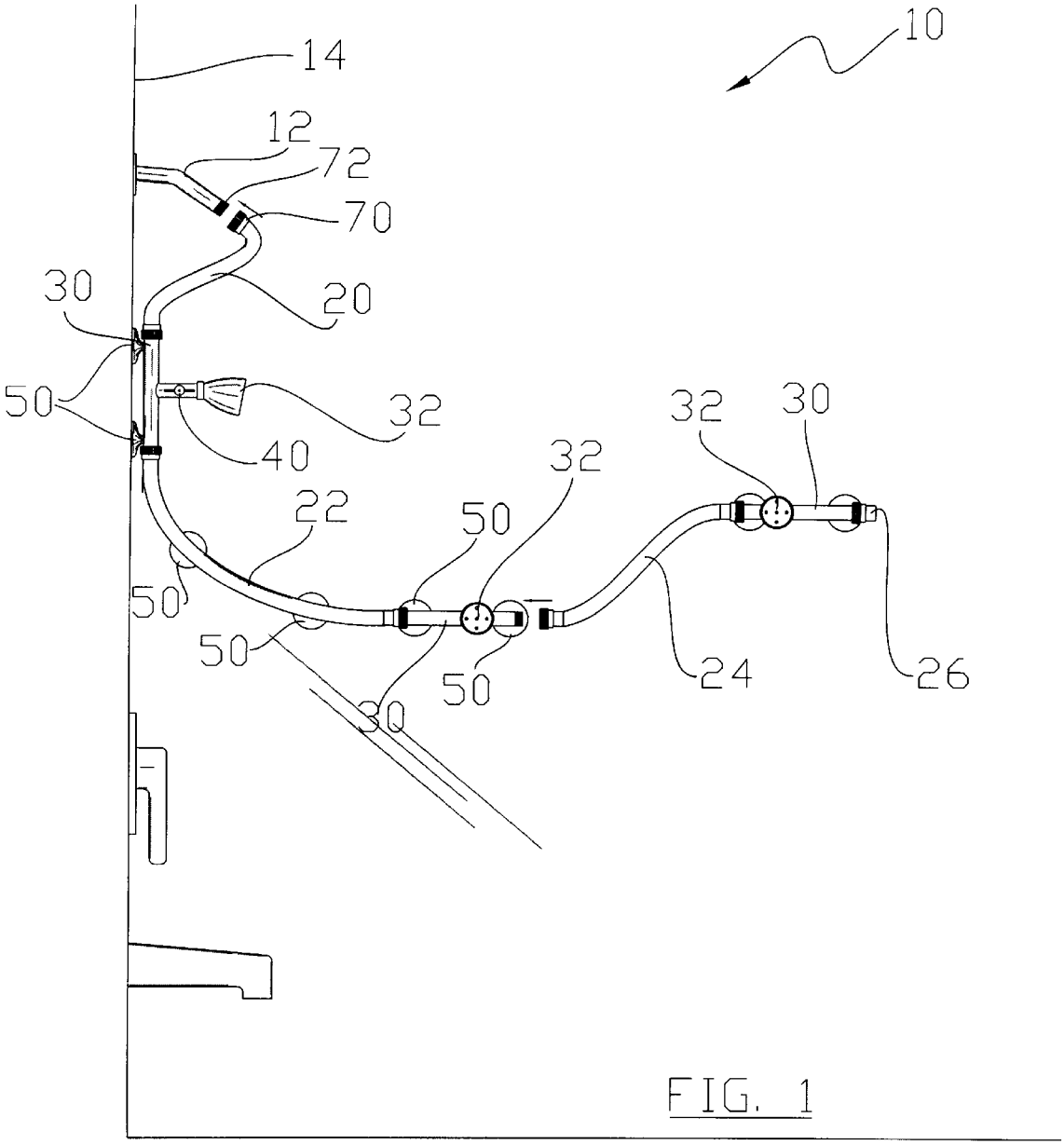
FIG. 1 is a side view of the present invention attached within a shower stall.
Figure 2:
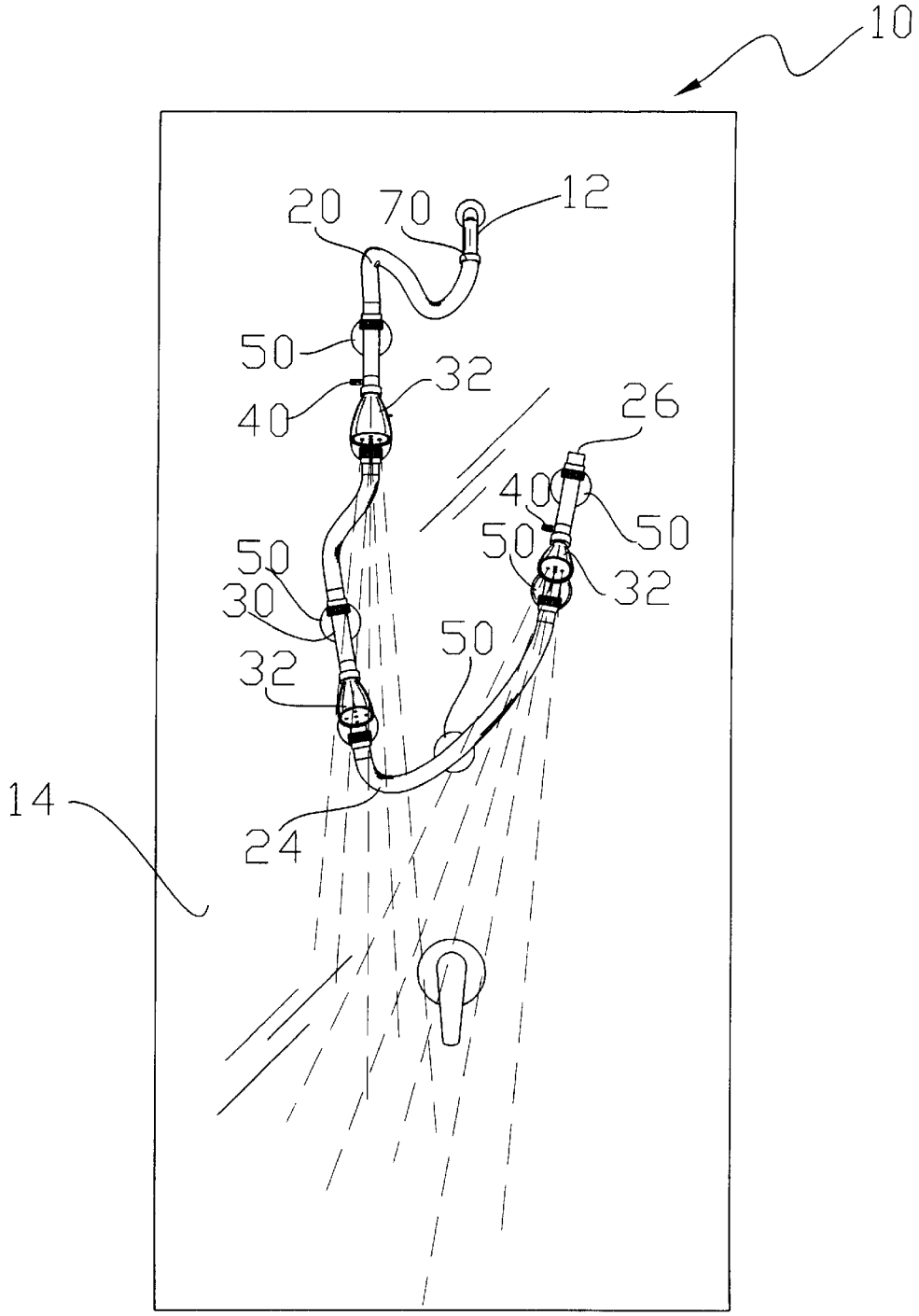
FIG. 2 is a front view of the present invention attached within a shower stall.

Turning now descriptively to the drawings, in which similar reference characters denote similar elements throughout the several views, FIGS. 1 through 4 illustrate an adjustable shower system 10, which comprises a plurality of tubes 20, 22, 24 having opposing female couplers 70, a plurality of connecting tubes 30 having opposing threaded ends 72 for threadably receiving the female couplers 70, a control valve 40 fluidly connected to the connecting tube 30, a showerhead 32 fluidly connected to the control valve 40, a plurality of suction cups 50 attached to the connecting tube 30 and the tubes 20, 22, 24, and an end cap 26 attached to that distal threaded end 72 of the last connecting tube 30. A first tube 20 is fluidly connected to the existing shower pipe 12 within a shower stall by simply removing the existing shower head.

As shown in FIG. 1 of the drawings, the existing shower pipe 12 is comprised of an elongate structure having a distal threaded end 72 for threadably attaching a conventional shower head. The shower pipe 12 may have various shapes and sizes as can be appreciated by one skilled in the art.

As shown in FIG. 1 of the drawings, a first tube 20 having a pair of opposing female couplers 70 is threadably and fluidly attached to the threaded end 72 of the shower pipe 12. The first tube 20 is preferably comprised of a flexible material such as but not limited to rubber or plastic. The length of the first tube 20 may vary from 0.5 to 8.0 feet as required to utilize within the shower stall.

Figure 3:
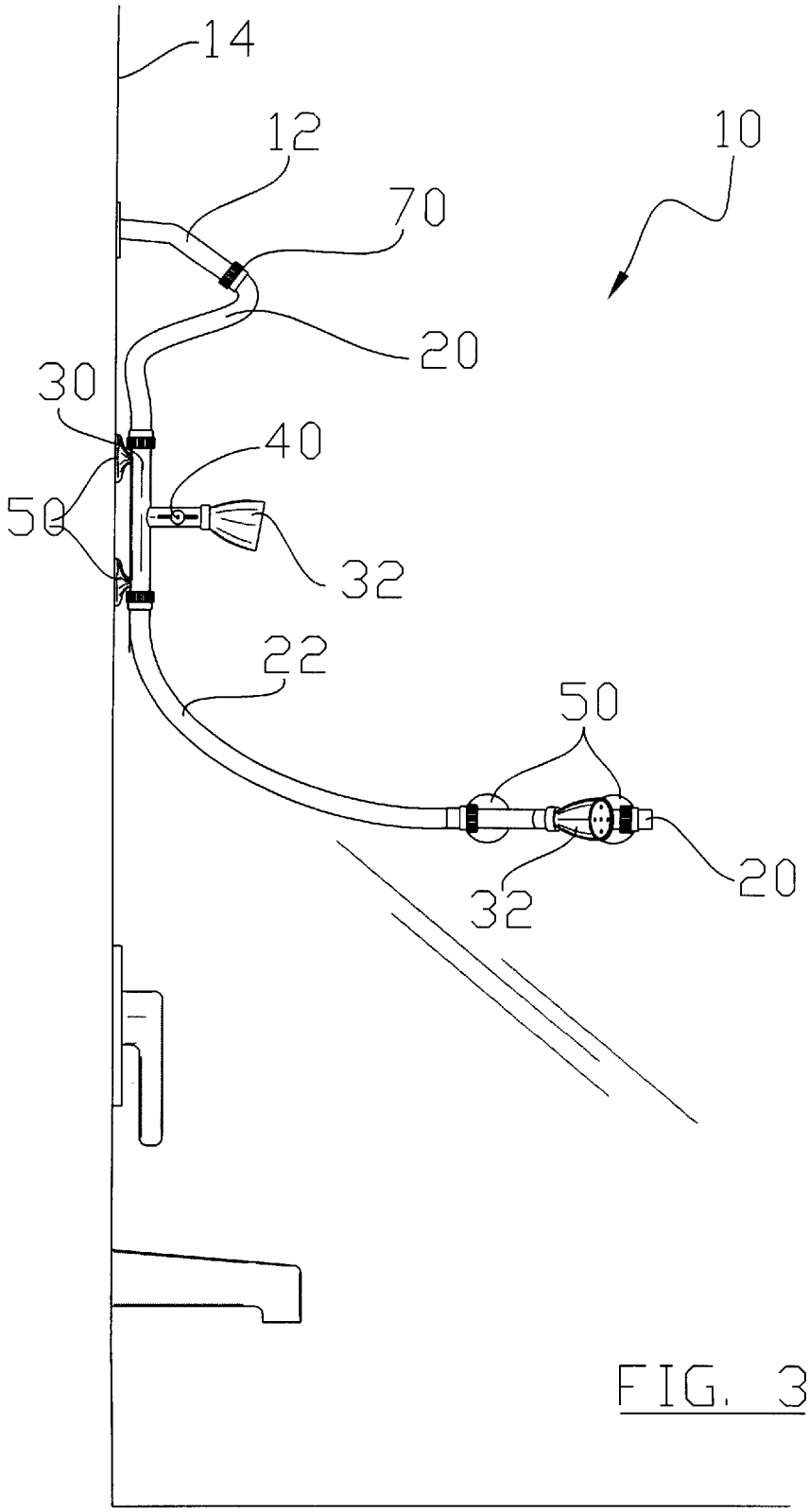
FIG. 3 is a side view of the present invention attached within the shower stall in a different embodiment.
Figure 4:
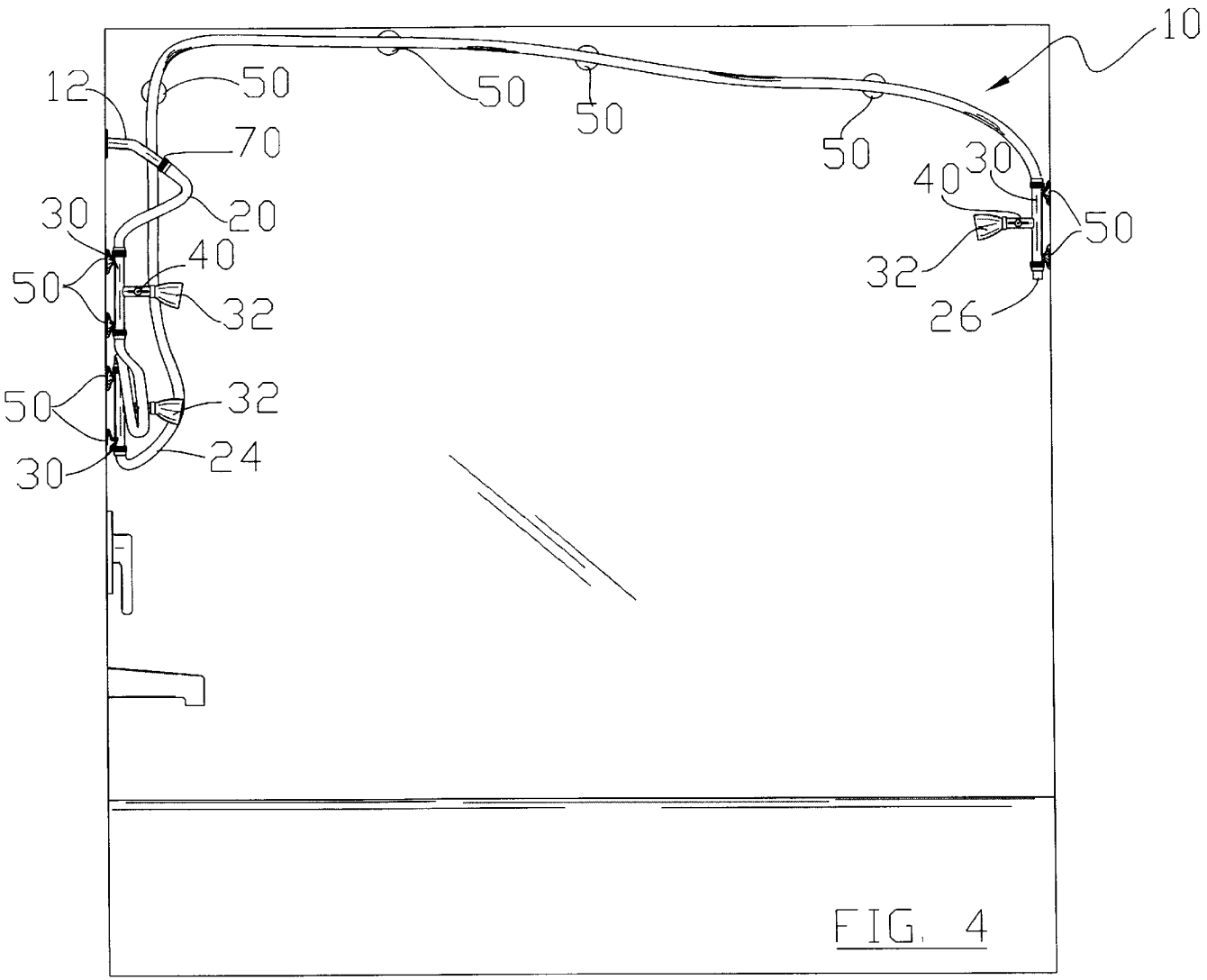
FIG. 4 is a side view of the present invention attached within the shower stall in a different embodiment.

As shown in FIGS. 1 and 3 of the drawings, a first connecting tube 30 having opposing threaded ends 72 is threadably and fluidly connected to the distal end of the first tube 20 opposite of the shower pipe 12. The first connecting tube 30 has an elongate structure with a traverse portion extending outwardly forming a T-shaped structure. A showerhead 32 is fluidly connected to the distal portion of the traverse portion of the connecting tube 30 for dispersing water from thereof. The showerhead 32 is preferably connected in a swivel manner for allowing adjustment of the direction of water flow. A control valve 40 is positioned within the traverse portion of the connecting tube 30 to allow for water flow control through the showerhead 32. The user may close, open or slightly open the control valve 40 as desired.

As further shown in FIG. 1 of the drawings, a plurality of suction cups 50 are attached to the connecting tube 30 and are capable of being removably attached to the wall 14 within the shower stall. The suction cups 50 are preferably attached to the connecting tube 30 utilizing a strap or similar structure. The suction cups 50 may also be attached to the tubes 20, 22, 24 for supporting the tubes 20, 22, 24 in a desired manner and location as further shown in FIG. 1 of the drawings.

As shown in FIGS. 1 and 3 of the drawings, a second tube 22 having a pair of opposing female couplers 70 is threadably and fluidly attached to the threaded end 72 of the connecting tube 30 opposite of the first tube 20. The second tube 22 is preferably comprised of a flexible material such as but not limited to rubber or plastic. A second connecting tube 30 having a structure similar to the first connecting tube 30 is fluidly connected to the distal end of the second tube 22. As shown in FIG. 3, the user may threadably connected an end cap 26 to the distal threaded end 72 of the connecting tube 30 to prevent water from flowing uncontrollably from the connecting tube 30. The user may also attached a third tube 24 to the second connecting tube 30 as shown in FIG. 1 of the drawings. As can be appreciated, a virtually unlimited number of combinations may be created using the present invention which are deemed to be readily apparent and therefore will not be discussed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable shower system, comprising:

a plurality of tubes having opposing female couplers at the distal ends thereof, wherein one of said plurality of tubes is threadably attached to a threaded end of an existing shower pipe;

a plurality of connecting tubes having opposing threaded ends threadably and fluidly connected between said plurality of tubes;

a plurality of showerheads fluidly connected to each of said plurality of connecting tubes;

a plurality of suction cups attached to each of said plurality of connecting tubes for removably securing said connecting tubes to a wall within a shower stall; and an end cap threadably attached to an exposed end of one of said connecting tubes.

2. The adjustable shower system of claim 1, wherein a total number of said plurality of tubes equals a total number of said plurality of connecting tubes.

3. The adjustable shower system of claim 2, wherein said total number of said tubes and said connecting tubes is three.

4. The adjustable shower system of claim 1, wherein said plurality of tubes are comprised of a flexible material.

5. The adjustable shower system of claim 4, wherein said plurality of tubes are comprised of plastic.

6. The adjustable shower system of claim 4, wherein said plurality of tubes are comprised of rubber.

7. The adjustable shower system of claim 1, wherein said plurality of showerheads are connected to said connecting tubes in a swivel manner.

8. The adjustable shower system of claim 1, wherein said connecting tubes are comprised of a T-shaped structure having a traverse portion fluidly connecting said showerheads.

9. The adjustable shower system of claim 1, wherein each of said suction cups are attached to said connecting tubes using a strap member.

10. The adjustable shower system of claim 1, including a plurality of suction cups attached to said plurality of tubes for removably securing to said wall of said shower stall.

11. An adjustable shower system, comprising:

a plurality of tubes having opposing female couplers at the distal ends thereof, wherein one of said plurality of tubes is threadably attached to a threaded end of an existing shower pipe;

a plurality of connecting tubes having opposing threaded ends threadably and fluidly connected between said plurality of tubes;

a plurality of traverse portions extending outwardly from said plurality of connecting tubes;

a plurality of showerheads fluidly connected to each of said traverse portions;

a control valve positioned within each of said plurality of traverse portions;

a plurality of suction cups attached to each of said plurality of connecting tubes for removably securing said connecting tubes to a wall within a shower stall; and an end cap threadably attached to an exposed end of one of said connecting tubes.

12. The adjustable shower system of claim 11, wherein a total number of said plurality of tubes equals a total number of said plurality of connecting tubes.

13. The adjustable shower system of claim 12, wherein said total number of said tubes and said connecting tubes is three.

14. The adjustable shower system of claim 11, wherein said plurality of tubes are comprised of a flexible material.

15. The adjustable shower system of claim 14, wherein said plurality of tubes are comprised of plastic.

16. The adjustable shower system of claim 14, wherein said plurality of tubes are comprised of rubber.

17. The adjustable shower system of claim 11, wherein said plurality of showerheads are connected to said connecting tubes in a swivel manner.

18. The adjustable shower system of claim 11, wherein each of said suction cups are attached to said connecting tubes using a strap member.

19. The adjustable shower system of claim 11, including a plurality of suction cups attached to said plurality of tubes for removably securing to said wall of said shower stall.

* * * * *